US006296124B1

(12) United States Patent
Zubrägel

(10) Patent No.: US 6,296,124 B1
(45) Date of Patent: Oct. 2, 2001

(54) SCREENING DEVICE FOR BULK MATERIALS

(75) Inventor: Albert Zubrägel, Lohne (DE)

(73) Assignee: Albert Zubrägel Maschinenbau GmbH, Lohne (DE)

( * ) Notice: Subject to any disclaimer, the term of this patent is extended or adjusted under 35 U.S.C. 154(b) by 0 days.

(21) Appl. No.: 09/654,866

(22) Filed: Sep. 5, 2000

(30) Foreign Application Priority Data

Sep. 6, 1999 (DE) ..... 199 42 402

(51) Int. Cl.[7] ..... B07B 13/05; B07B 13/07; B07B 13/075; B07C 5/12

(52) U.S. Cl. ..... 209/672; 209/671; 209/667

(58) Field of Search ..... 209/672, 671, 209/660, 667

(56) References Cited

U.S. PATENT DOCUMENTS 5,847,273 12/1998 Zubragel .

FOREIGN PATENT DOCUMENTS 0 838 667 10/1997 (EP) .

*Primary Examiner*—Donald P. Walsh
*Assistant Examiner*—David A Jones
(74) *Attorney, Agent, or Firm*—Collard & Roe, P.C.

(57) ABSTRACT

A screening device for separating fractions of bulk materials, and has at least one screening floor, with a plurality of shafts aligned parallel to each other, which rotate at the same speed, in the same direction of rotation. Screening stars are mounted on these shafts, with teeth projecting radially in relation to the shaft. The screening stars are positioned interleaved with one another. The diameter d of each screening star is approximately determined according to the formula $$d = \sqrt{2t^2}$$

whereby t is the spacing between the longitudinal axes of shafts disposed adjacent to each other. Viewed in the direction of rotation, the leading flank of each tooth of the screening stars extends along an approximately straight line near the tip of the tooth and defines a curve from the tooth trough to the flank area.

7 Claims, 7 Drawing Sheets

SCREENING DEVICE FOR BULK MATERIALS

BACKGROUND OF THE INVENTION

1. Field of the Invention

This invention relates to a screening device for bulk materials, having at least one screening floor, and with a plurality of shafts aligned parallel with each other and rotating at the same speed in the same direction. The invention provides screening stars with teeth, projecting radially from shafts where they are mounted, interleaved with the screening stars of the adjacent, parallel shaft.

2. The Prior Art

Screening devices of this type are generally known from European Patent No. EP 0 838 667 A2. Fractions of the bulk material are separated from each other by means of the screening stars installed on a screening floor, where they are mounted with torsional strength on rotating shafts. By means of the spacing present between each two adjacent screening stars, which rotate with their teeth revolving pass each other, these spacings being present due to the fact that the screening stars are mounted next to each other, the screening stars form a latticework of gaps through which the desired grain fraction of the bulk material can be separated from an oversized grain fraction. The spacings available between the screening stars are dimensioned so that the particles of the desired grain fraction drop through the gaps, whereas the particles of the oversized grain fraction are prevented from passing through. By means of the screening stars mounted on, and rotating with the shafts, grain particles are moved across the screening floor and are transported, for example to a collection station.

The grain particles of the oversize grain fraction are moved in this process through the teeth of the screening stars, where they also can drop down and be received in the troughs of the teeth, so that they can be ejected again from these troughs by the centrifugal forces acting on them as the screening stars are rotating. This ejection from the trough of a tooth can be supported by the teeth of a adjacent screening star mounted on a neighboring shaft, so that the front flank, viewed in the direction of rotation of the screening star, is brought close to an oversize grain particle present in the trough of a tooth. The oversized particle is then lifted from the trough of the tooth by the further rotation of the shaft, supporting the screening star, until it is ejected therefrom. With such screening apparatus, it is known that due to the interaction between two teeth of the screening stars, neighboring on one another, a crushing of particles of the oversized grain fraction occurs as well. These particles are jammed between the flanks of a tooth, with the disadvantageous result that the screening stars become clogged up. This clogging of the screening stars, until they are completely blocked, finally leads to a soiling of the screening device. Moreover, the complete closure of the spacing between the screening stars may be caused in disadvantageous ways under certain circumstances, so that the screening efficiency of the practically clogged screening device is reduced, or even completely canceled. Furthermore, pieces of debris getting jammed between the screening stars such as, for example, pieces of wood, nails and rocks may block the rotational motion of individual or several shafts, causing interference with the entire screening device and the screening process. The screening device then has to be shut down, and cleaned in a cumbersome way before it can be restarted.

SUMMARY OF THE INVENTION

The present invention provides a screening device of the type specified above that permits a superior separation of the desired grain fraction from the oversized grain fraction, without causing any jamming and squeezing phenomena of the oversized grains between the individual screening stars.

This problem is solved according to the invention in that the diameter d of each screening star is approximately determined according to the formula $$d = \sqrt{2t^2},$$

whereby t is the spacing between the axes of rotation between two shafts disposed adjacent to each other. Moreover, each flank of the teeth leading in the direction of rotation has at least one section extending in a straight line. The section of the tooth flank extending in a straight line is the section of each leading tooth flank that is farthest removed from the trough of the tooth, i.e. this section is the one that ends at the tip of the tooth.

The invention solves the problem of the prior art by a proper dimensioning of the diameter of the screening stars, on the one hand, and on the special shape provided for the teeth of these screening stars, on the other. It has been found that if the diameter d of each screening star is dimensioned based on the above formula, depending upon the spacing between two shafts disposed adjacent to one another, it is possible to separate the oversized grain fraction from the fraction with the desired grain size, in a clean, smooth operation. With this dimensioning of the diameter, the teeth of two screening stars mounted on two shafts and running adjacent to each other cooperate with each other in an optimal way. Therefore, an oversized grain particle located in the trough of the tooth of a screening star is lifted by the leading flank, viewed in the direction of rotation of the tooth of the adjacent screening star. Stuck particles of the oversized grain fraction are advantageously forcefully transported approximately radially outwards from the trough of the tooth. In addition to the dimensioning of the diameter, the design of the leading tooth flank of each tooth of each screening star contributes to this ejection as well in that this flank of the tooth is provided with a shape that is approximately straight, i.e. the flank of the tooth is advantageously set to be inclined rearwards, and consequently against the direction of rotation, at a defined angle in relation to the radial of the screening star.

Each tooth flank has at least one section that extends in a straight line. The result is that the oversized grain fraction is separated from the fraction with the desired grain size without any jamming or crushing of grains. The screening stars do not clog up, so that the gap between the screening stars is advantageously not closed. This assures that the particles with the desired grain size can be transported through these gaps without any hindrance, and provides an optimal screening efficiency of the screening device, as defined by the invention.

Furthermore, the screening device as defined by the invention offers the very special benefit that it can be started up also under load, i.e. with bulk material already loaded on a screening floor. Since no jamming or crushing or the like occurs, i.e. obstructions of the screening process that the drive of the device would have to overcome with the help of adequate power reserves, the power output of the drive of the screening device as defined by the invention inevitably can be lower than with conventional screening installations.

The invention also provides that zones of the flanks of the teeth, leading in the direction of rotation, each have a curved, and particularly an approximately parabolic shape so that starting from the trough of the tooth, the tooth flank has a concave shape. This configuration of the leading flank of the tooth optimizes lifting of a particle of the oversized grain fraction from the trough of a tooth of an adjacent screening star.

The section of each tooth flank, leading in the direction of rotation that is farthest removed from the bottom of the tooth trough, i.e. the section ending in the tip of the tooth may then extend in a straight line. This straight expanse of defined sections of the flanks of the teeth of screening stars disposed adjacent to each other can be set to a defined position of rotation of the shafts, and the screening stars mounted thereon so that an angle of 90° is formed between the leading flanks of the teeth. This right angle assures optimal ejection of an oversized grain particle present in the tooth trough of the one screening star. The oversized grain particle is freely ejected from the trough of the tooth, and no jamming or crushing will occur. This free ejection is achieved by virtue of the special design of the flanks of the teeth. Due to the special dimensioning of the diameters of both screening stars, the 90-degree position of the leading flanks of the teeth in relation to one another is assured.

Furthermore, the design of the screening stars has to be determined based on the oversized grain fraction that has to be sifted. In particular, based on the size of the oversized grain fraction it is necessary to determine the number of teeth that each screening star requires. A screening star with, for example 8 teeth is suitable in most application cases. However, screening stars with 12 or 24 teeth are also possible, specifically in cases where the particles of the oversized grain fraction have smaller dimensions. Each screening star can have a number of teeth that can be divided by 4 without a balance. Thus the lowest possible number of teeth is 4, because if several shafts have another tooth number, the oversized grain is not transferred or eliminated at a right angle.

A special benefit is obtained if each screening star is thinner than the width of the gap between screening stars rotating next to each other. The free screening passage area is enlarged in this way for the material with the desired grain size in an advantageous manner.

The rotational speed of the shafts of the screening device as defined by the invention is variable. However, it is necessary to ensure that the shafts of each screening floor rotate at the same speed and in the same direction.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
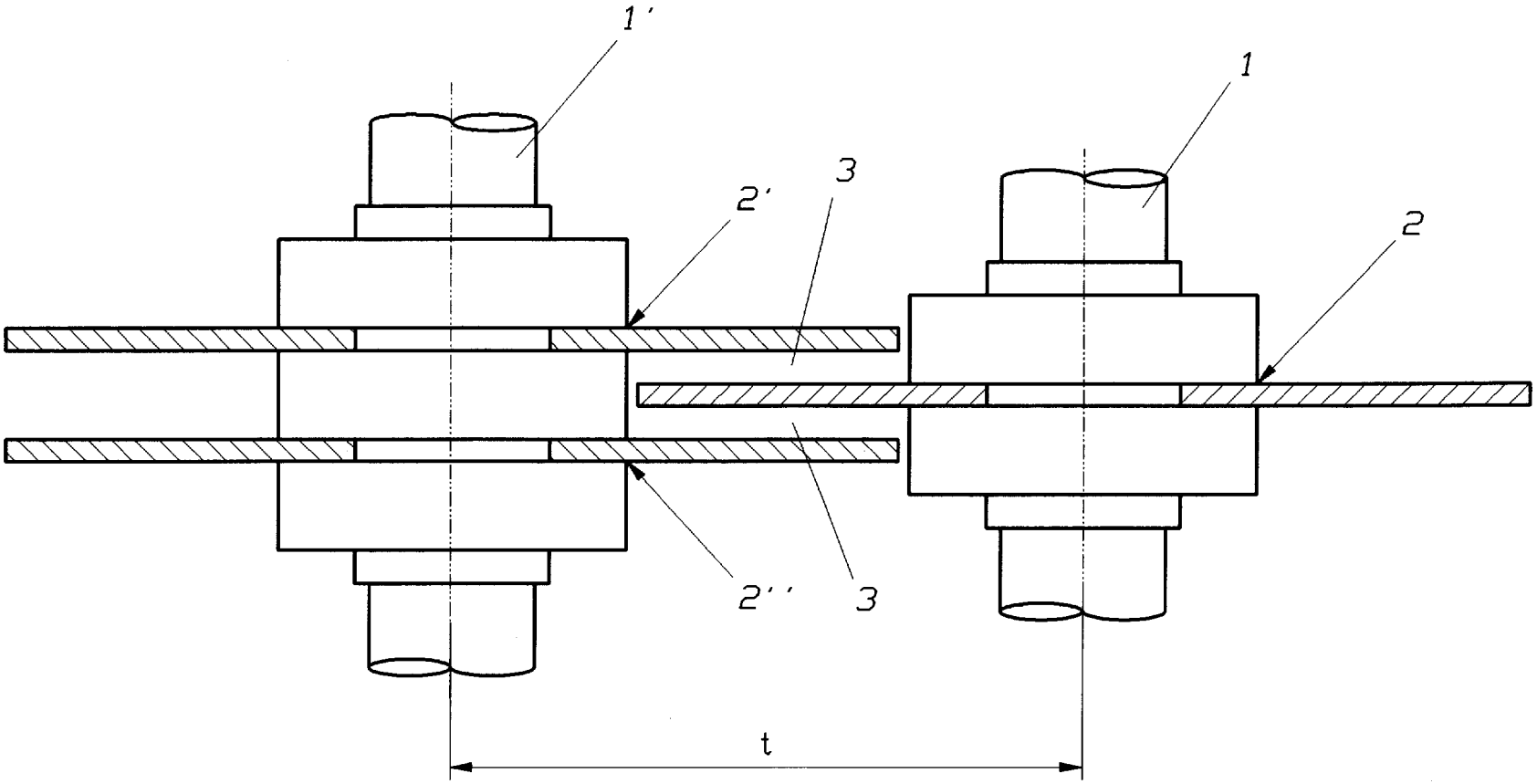
FIG. 1 shows a top view of a part of a screening floor of a screening device for bulk materials, with screening stars mounted on shafts.

Referring to FIG. 1 there is shown two shafts 1 and 1' (shown broken off) of a part of a screening floor of the screening device. Shafts 1 and 1' are aligned parallel with each other and arranged in one and the same plane. The shafts rotate about their longitudinal axes, whereby the two shafts 1 and 1' rotate at the same rotational speed.

Each screening floor of a screening device consists of a multitude of shafts that each are fitted with a multitude of screening stars. A screening device has at least one screening floor.

The screening stars 2 and 2', 2''' are mounted on shafts 1 and 1', respectively. Screening stars 2, 2' and 2'' are shown by a sectional view. The two screening stars 2' and 2'' are mounted on shaft 1' shown in FIG. 1 on the left side, and a screening star 2 is mounted on the right-hand shaft 1. Screening stars 2, 2' and 2'' are mounted on shafts 1, 1' interleaved with each other so that they rotate pass each other with a predetermined gap 3 formed between them, whereby screening star 2 of right-hand shaft 1 projects into a free space between the two screening stars 2', 2'' on left-hand shaft 1'. Due to this projection, gap 3 is formed between the surfaces of the screening stars 2, 2' and 2'' facing each other. In each case, gap 3 results from the spacing between the side surfaces of the screening stars 2, 2' and 2''. An opening is made available by gap 3 through which the desired grain fraction can drop. By rotating shafts 1 and 1' and screening stars 2, 2' and 2'', which are mounted on these shafts with torsional strength, a force is exerted on the mixture comprising the oversized grain fraction and the desired grain fraction that leads to a separation of the two fractions. The particles of the desired grain fraction can drop through gap 3, and can thus be separated from the oversized grain fraction.

The particles of the oversized grain fraction do not drop through gap 3 because the latter is dimensioned smaller than the dimensions of the particles of the oversized grain fraction. A particle of the oversized grain fraction can only drop into the trough of a tooth located between two successive teeth of a screening star.

Figure 2:
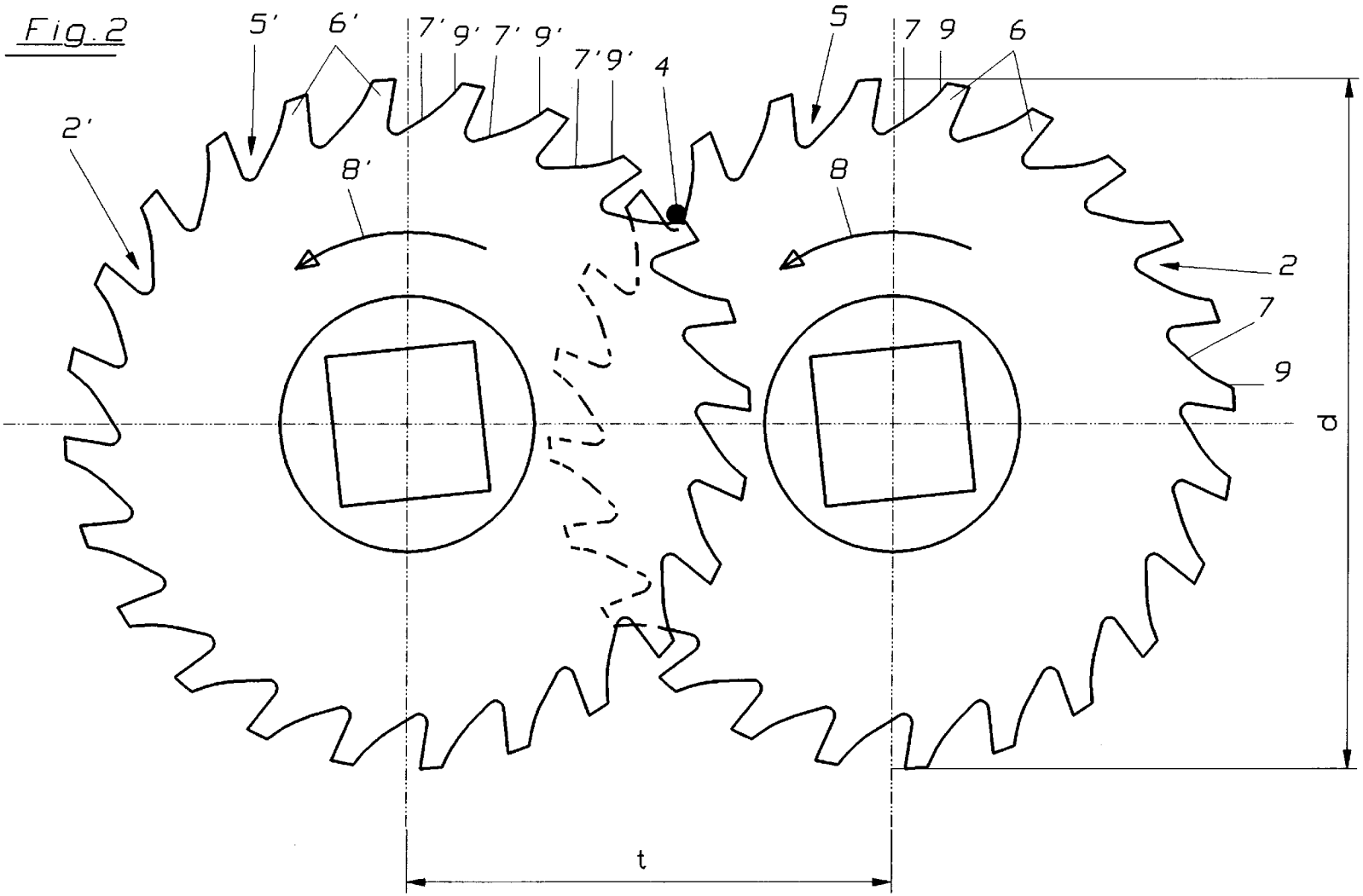
FIGS. 2–5 show side views of two screening stars of the screening device of FIG. 1, showing the screening stars located in different positions of rotation in relation to each other.

FIGS. 2–5 show a particle of the oversized grain fraction that has been received in a trough 5 of a tooth. FIG. 2 shows the particle 4 in the zone of the bottom of tooth trough 5 of the screening star 2, whereby the particle has already been lifted from the tooth trough 5 by the entire section 9' of the tooth flank 7' of a tooth 6' of the neighboring screening star 2' (or 2'', respectively), tooth flank 7' being the leading flank in the direction of rotation. A special dimensioning of the cooperating screening stars 2, 2' and 2'' assures that particle 4 is lifted by tooth 6' of the adjacent screening star 2. The diameter d of each of the screening stars 2, 2' and 2'' is equal to the square root of the product of $2 \times t^2$, whereby t is the spacing between the longitudinal axes of the shafts 1, 1', which are not shown in greater detail in FIG. 2. The lifting of particle 4 is supported also by the slightly curved, approximately parabolic contour of the leading tooth flank 7, 7'. Leading flank 7, 7', in its section 9, 9' farthest removed from the bottom of tooth trough 5, 5', or about in the zone of the tip of a tooth 6, 6', changes from a concavely curved shape into a straight-lined form.

Figure 3:
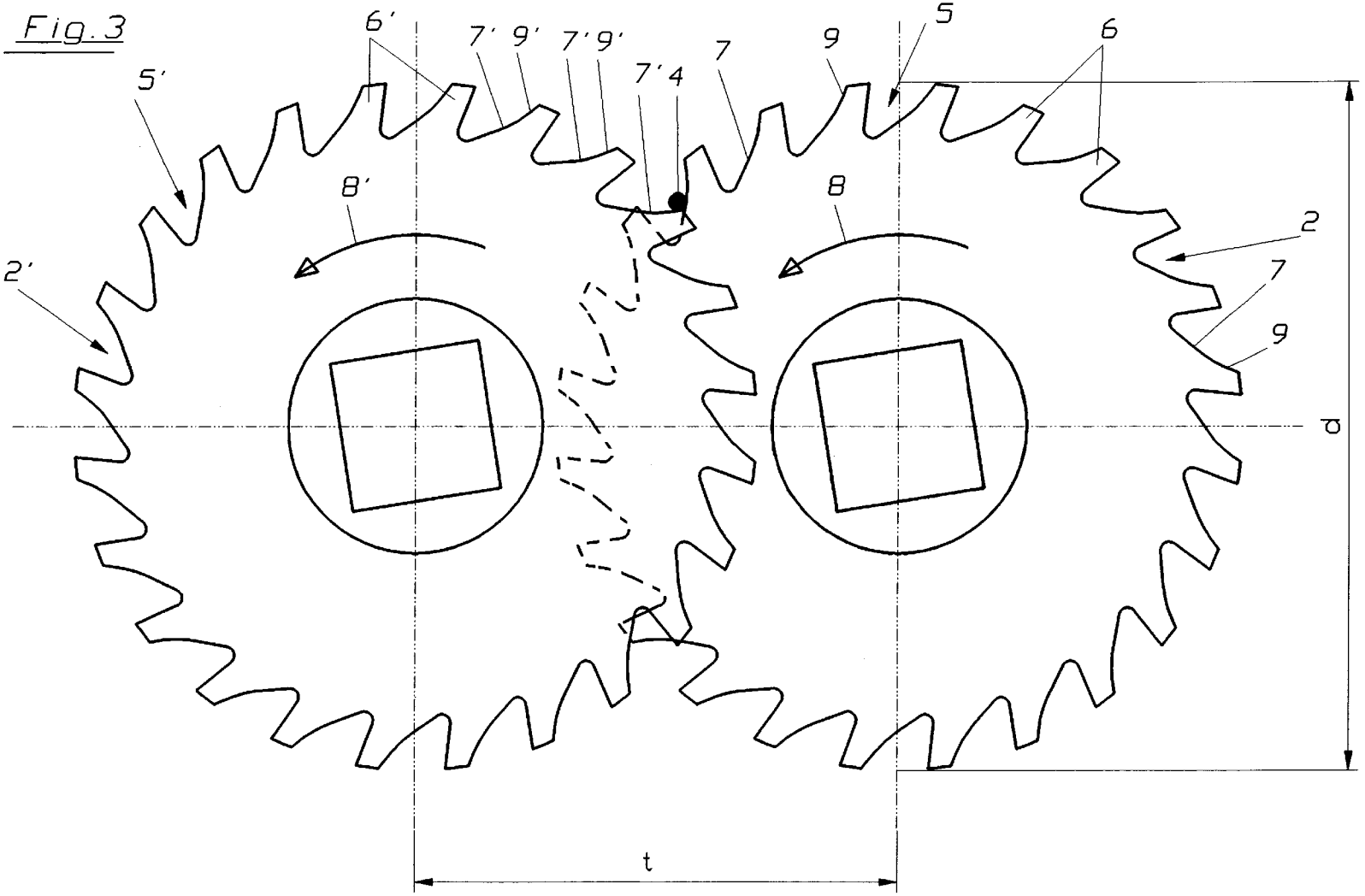

The rotation of the two screening stars 2, 2' is indicated by arrows 8, 8'. With continuing rotation and change of screening stars 2, 2', 2'' into other positions of rotation, as indicated in FIGS. 3, 4 and 5, particle 4 is lifted from the tooth trough 5 of the screening star 2 by tooth 6' of screening star 2'.

Figure 4:
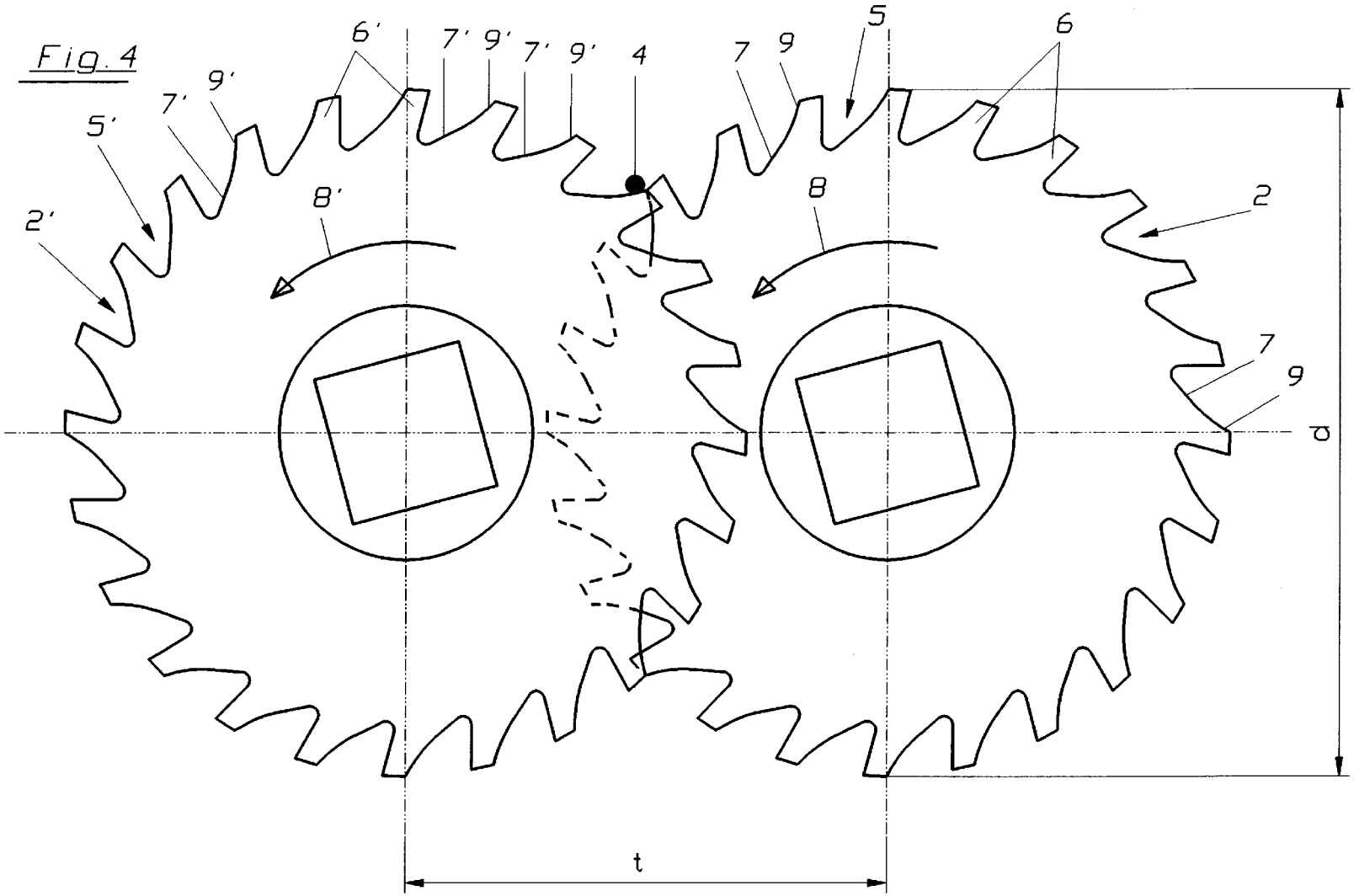

When screening stars 2, 2' are in the rotational position shown in FIG. 4, a right angle is formed between straight sections 9, 9' of the leading tooth flanks 7, 7'. At this angle, particle 4 of the oversized grain fraction can be freely ejected because the outward path of ejection is not obstructed by any projecting tooth flank 7, 7', or tooth flank 7, 7' that would be hindering this ejection in some other way. The right angle is set due to the special shape of tooth flanks 7, 7' with their sections 9 and 9', and as a result of the special dimensioning of screening stars 2, 2'.

Figure 5:
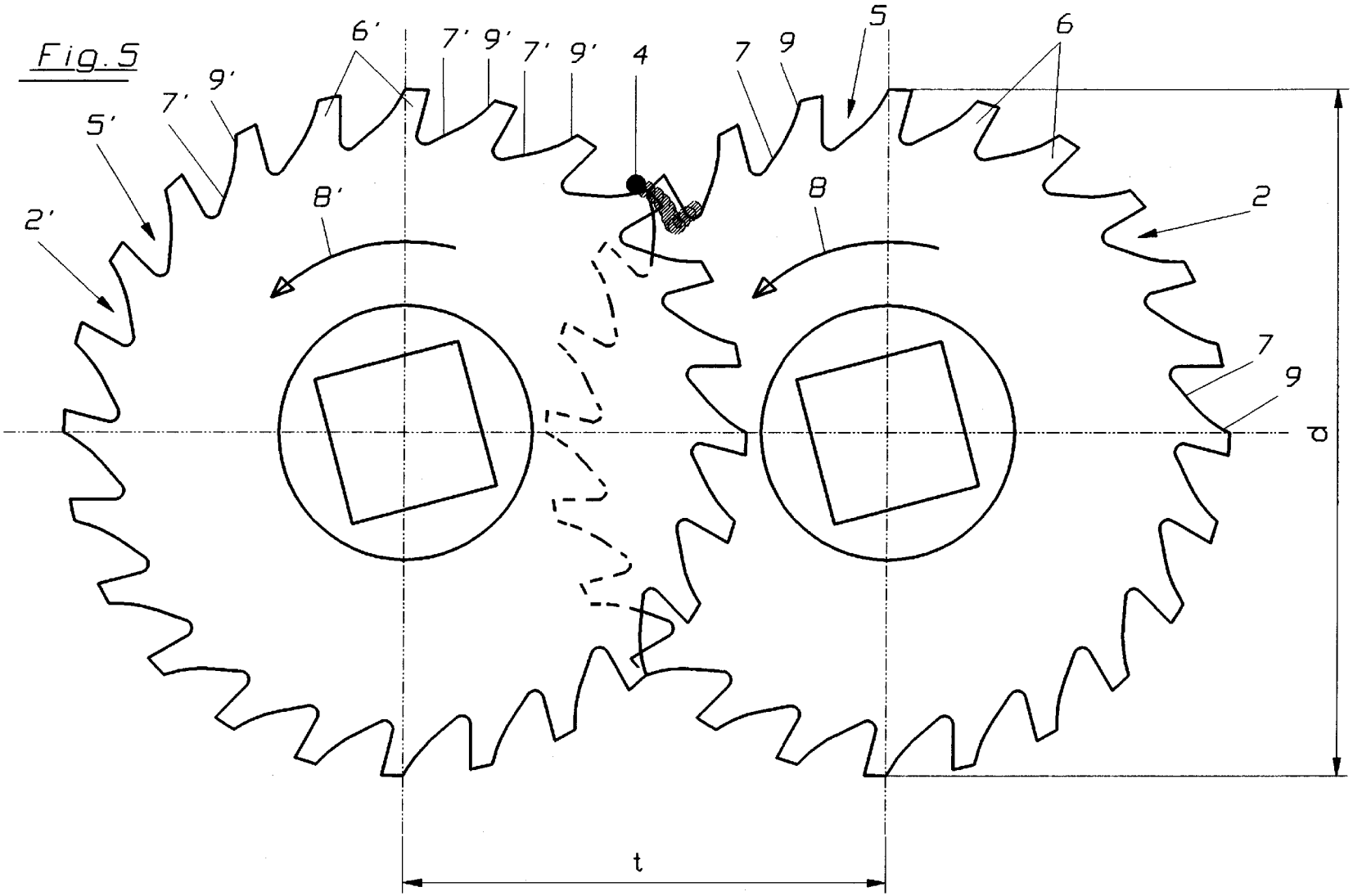

FIG. 5 shows the path of movement of particle 4 across various rotational positions of screening stars 2, 2'. It can be seen that particle 4 is first carried along in tooth trough 5 by just a few degrees of the rotational motion, but then lifted in a curve from this trough by tooth flank 7' with its section 9' of a tooth 6' of the adjacent screening star 2'. Any crushing or jamming of particle 4 is excluded because in no rotational position, an angle of less than 90° is formed between tooth flanks 7, 7', or their sections 9, 9', by any of teeth 6, 6' interacting with one another.

Figure 6:
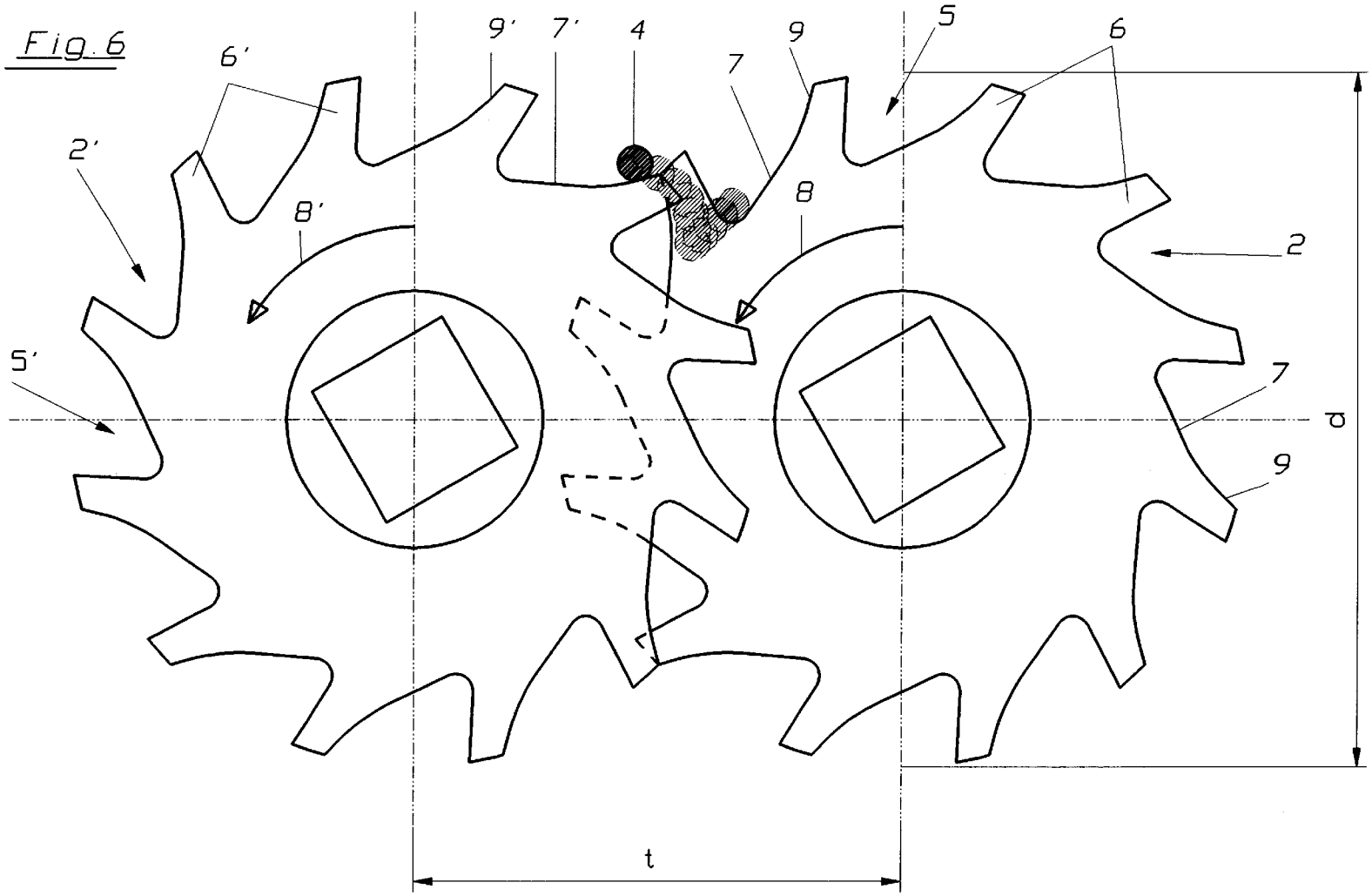
FIG. 6 shows a side view of two screening stars of another embodiment of the screening device.
Figure 7:
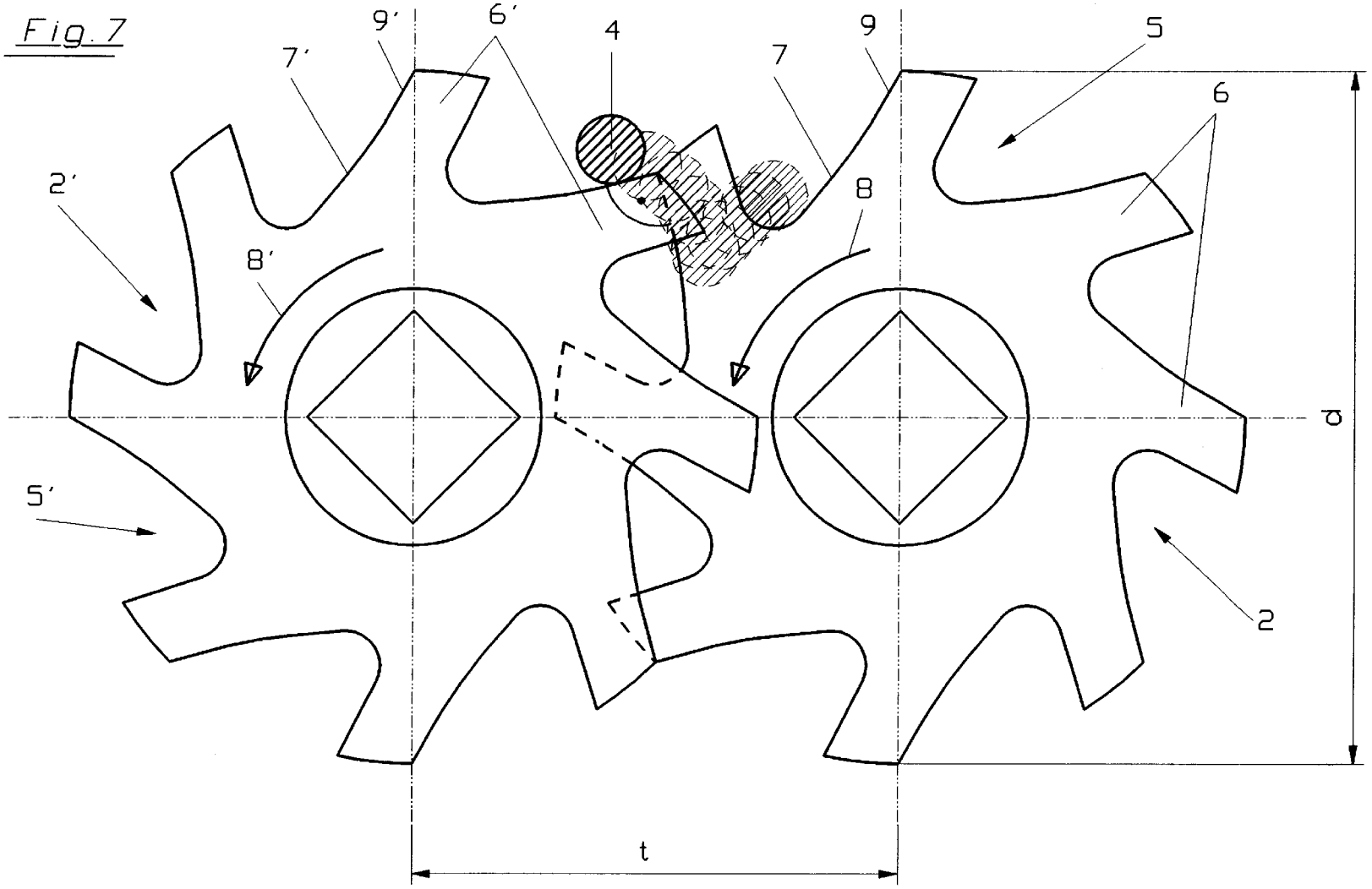
FIG. 7 shows a side view of two screening stars of a third embodiment of the screening device.

FIGS. 6 and 7 show similar movements of the particles 4 of an oversized grain fraction in each case. Here, particles 4 are dimensioned larger, which results in other embodiments of screening stars 2 and 2' with regard to the number of teeth 6, 6', respectively. In FIG. 6, each screening star has 12 teeth. The design of the leading (viewed in the direction of rotation) tooth flanks 7, 7', with their straight-lined sections 9, 9' remains unchanged, as compared to the design according to FIGS. 2 to 5. Also in the present case, the diameter d of each screening star is equal to $$d = \sqrt{2t^2}.$$

In FIG. 7, the particle 4 of the oversized grain fraction is enlarged even more, resulting in a further reduction of the number of the teeth of the screening stars 2, 2'. In the present case, each screening star 2 has eight teeth. The design of the teeth 6, 6' corresponds with the one in the preceding exemplified embodiments. The diameter of each screening star is equal to the square root extracted from $$d = \sqrt{2t^2}.$$

Due to the fact that all screening stars of each shaft of a screening floor are identical with respect to their shape and dimensions, as well as in the way they are arranged next to one another, and that each screening star is secured against rotating independently by a safety element in the form of a square hole or some other square breakthrough, by means of which the screening star is mounted on corresponding form-locking elements of the shaft, thus all screening stars are always in practically identical rotational positions in relation to one another. The 90° position of straight sections 9, 9', 9" of tooth flanks 7, 7', 7" shown by way of example in FIG. 7 is thus simultaneously set with all screening stars 2, 2', 2" of the entire screening floor.

Accordingly, while only a few embodiments of the present invention have been shown and described, it is obvious that many changes and modifications may be made thereunto without departing from the spirit and scope of the invention.

What is claimed is:

1. A screening device having a screening floor for collecting bulk materials comprising:

a plurality of shafts disposed above the screening floor, aligned parallel with each other, and having a distance "t" between the axis of rotation of adjacent shafts, wherein said plurality of shafts rotate at the same speed in the same direction;

screening stars (2, 2', 2") mounted on said plurality of shafts, said screening shaft being spaced apart on said shafts and wherein said screening shaft of adjacently mounted parallel shafts interleave with each other to define a gap therebetween, each of said screening stars comprises:

a plurality of equally spaced apart teeth, defined by a tooth trough (5) and a tooth tip, and formed on the periphery, said teeth projecting radially in relation to said plurality of shafts, each of said plurality of teeth comprising a leading tooth flank (7, 7') extending from said tooth trough (5) to the tip in a direction opposite to the direction of rotation; each leading tooth flank having a straight section (9, 9') adjacent the tip extending in a straight line, and wherein said screening stars have a diameter "d" determined by $$d = \sqrt{2t^2},$$

so that an angle of 90 degrees is formed between straight sections of leading tooth flanks of adjacent screening stars to eject an oversized particle from the tooth trough of one of said screening stars.

2. The screening device according to claim 1, wherein zones of the leading tooth flanks (7, 7') of the teeth (6, 6') extend in a curved line, whereby the curve is a concave parabola starting from the tooth trough (5) and extending along the leading tooth flank (7, 7') of said tooth.

3. The screening device according to claim 1, wherein each of said screening stars (2, 2', 2") has a thickness less than the width of said gap (3).

4. The screening device according to claim 1 wherein said teeth of said screening stars (2, 2', 2") is a multiple of 4.

5. The screening device according to claim 4, wherein each of said screening stars (2) has eight teeth (6, 6').

6. The screening device according to claim 4, wherein each of said screening stars (2) has twelve teeth (6, 6').

7. The screening device according to claim 1 wherein said rotational speed of said plurality of shafts (1, 1') is variable.

* * * * *